United States Patent [19]

Hsing et al.

[11] Patent Number: 4,626,169

[45] Date of Patent: Dec. 2, 1986

[54] SEAL MEANS FOR A BLADE ATTACHMENT SLOT OF A ROTOR ASSEMBLY

[75] Inventors: Frederick F. Hsing, Windsor; John A. Leogrande, West Hartford, both of Conn.

[73] Assignee: United Technologies Corporation, Hartford, Conn.

[21] Appl. No.: 663,927

[22] Filed: Oct. 23, 1984

Related U.S. Application Data

[62] Division of Ser. No. 561,016, Dec. 13, 1983, Pat. No. 4,505,640.

[51] Int. Cl.[4] ..... F01D 5/18

[52] U.S. Cl. ..... 416/95; 416/96 R; 416/220 R

[58] Field of Search ..... 416/220 R, 95, 97 R, 416/219 R, 248, 500, 90 R, 96 R, 96 A, 97 A, 221; 277/53, 26, 235 A; 415/174, 175, 180; 52/211, 204, 739

[56] References Cited

U.S. PATENT DOCUMENTS

| | | | |
|---|---|---|---|
| 2,616,531 | 11/1952 | Young | 52/211 |
| 2,928,651 | 3/1960 | Turnbull | 416/221 |
| 3,253,366 | 5/1966 | Kelleher | 52/204 |
| 3,266,770 | 8/1966 | Harlow | 416/220 R |
| 3,554,668 | 1/1971 | Wagle | 416/220 |
| 3,610,778 | 10/1971 | Suter | 416/221 |
| 3,751,183 | 8/1973 | Nichols et al. | 416/220 |
| 3,879,831 | 4/1975 | Rigney et al. | 415/174 |
| 4,057,362 | 11/1977 | Schwaebel | 277/53 |
| 4,212,587 | 7/1980 | Horner | 416/96 R |
| 4,453,891 | 6/1984 | Forestier | 416/220 R |
| 4,468,168 | 8/1984 | Aubert | 415/175 |
| 4,477,087 | 10/1984 | Sutter, Jr. et al. | 277/235 A |
| 4,505,640 | 3/1985 | Hsing et al. | 416/97 R |
| 4,531,889 | 7/1985 | Grondahl | 416/96 R |

FOREIGN PATENT DOCUMENTS

| | | | |
|---|---|---|---|
| 0830064 | 5/1981 | U.S.S.R. | 277/53 |

*Primary Examiner*—Robert E. Garrett
*Assistant Examiner*—John Kwon
*Attorney, Agent, or Firm*—Gene D. Fleischhauer

[57] ABSTRACT

A seal means 66 for a blade attachment slot of a rotor assembly 12 is disclosed. Various construction details which adapt the rotor assembly to block the leakage of cooling air from the blade attachment slot 40 as the cooling air is flowed to a rotor blade 22 are developed. In one embodiment, the seal means has a seal plate 68 and baffles 70,72 integral with the seal plate which define a cooling air chamber for receiving cooling air from a passage way 38 in a rotor disk 20. The seal plate extends axially and laterally to block the leakage of cooling air in the radial direction. Baffles extend radially from the plate for blocking the leakage of cooling air in the axial direction.

3 Claims, 7 Drawing Figures

SEAL MEANS FOR A BLADE ATTACHMENT SLOT OF A ROTOR ASSEMBLY

This is a division of application Ser. No. 561,016 filed on Dec. 13, 1983, now U.S. Pat. No. 4,505,640.

TECHNICAL FIELD

This invention relates to gas turbine engines and more particularly to a coolable rotor disk-blade assembly for such an engine. The concepts of this invention were developed in the field of axial flow gas turbine engines and have application to rotor assemblies in other fields.

BACKGROUND ART

Axial flow gas turbine engines generally include a compression section, a combustion section and a turbine section. A flow path for hot working medium gases extends axially through the sections of the engine. The gases are compressed in the compression section, burned with fuel in the combustion section and expanded through the turbine section to produce useful work.

A rotor assembly in the turbine section is used to extract useful work from the hot, pressurized gases. The rotor assembly includes a disk and a plurality of rotor blades which extend outwardly across the working medium flow path. The rotor blades, bathed in the hot working medium gases, are cooled to prevent overheating.

One example of a coolable rotor assembly is shown in commonly owned U.S. Pat. No. 4,279,572 issued to Auriemma entitled "Sideplates For Rotor Disk and Rotor Blades". The rotor assembly shown in Auriemma includes a rotor disk having a plurality of circumferentially spaced blade attachment slots. A rotor blade at each slot has a root spaced radially from the disk leaving a cavity therebetween. Cooling air is ducted from a source of supply via passages 50 to the cavity in the blade attachment slot. The cavity provides a plenum to supply cooling air to the coolable blade. Cooling air is flowed from the cavity either directly to the blade or through an orifice plate which meters the flow of cooling air from the cavity to the blade.

The cooling air is pressurized to an extent that enables the air to flow from the cavity through the rotor blade and thence to the high pressure environment of the working medium flow path. One source of pressurized cooling air is the compression section of the engine. As the working gases are passed through the compressor section, a portion of the pressurized gases (air) is bled from the working medium flow path. The pressurized air is ducted through the engine to a region adjacent to the disk. Because the cooling air is removed from the working medium flow path after energy is expended by the engine to pressurize the gases, the ineffective use or loss of pressurized air decreases the efficiency of the engine.

Accordingly, scientists and engineers are searching for ways to decrease the need for pressurized cooling air by finding and blocking cooling air leak paths to avoid waste of the cooling air. Of particular interest is the loss of cooling air from the cavity in the blade attachment slot through leak paths which extend between the rotor blade and the rotor disk.

DISCLOSURE OF INVENTION

According to the present invention, a seal means for a blade attachment slot of a coolable rotor disk-blade assembly has a first element which extends axially and laterally in the slot between the blade and the disk and at least two baffles which extend radially and laterally from the first element across the slot into proximity with the disk to define a chamber for cooling air in flow communication with a passage for cooling air in the disk and a passage for cooling air in the blade.

In accordance with one embodiment of the present invention, the seal means has a shearable coating which adapts the first element to engage both the rotor blade and the rotor disk under operative conditions and accepts each of the baffles to engage the rotor disk under operative conditions.

A primary feature of the present invention is a rotor assembly having a coolable rotor disk and an array of rotor blades extending outwardly from the disk. The rotor disk has a plurality of circumferentially spaced slots which adapt the rotor disk to receive the rotor blades. Each rotor blade has a root disposed in the slot to engage the disk. The root is spaced radially from the disk to leave a cavity therebetween. A passage for cooling air at each slot extends from a source of cooling air to the slot. Each blade has a passage for cooling air which is in flow communication with the blade attachment slot. Another primary feature of the present invention is a seal means for the blade attachment slot. The seal means is disposed in the cavity between the blade and disk. A first element disposed in the slot extends axially and radially and has an orifice therethrough which places the cavity in flow communication with the cooling passage in the rotor blade. At least two baffles on either side of the orifice extend radially from the first element across the slot into proximity with the disk to define with the first element a chamber for cooling air. The chamber is in flow communication with the passage for cooling air in the disk. In one embodiment the seal means is formed of a material having a greater coefficient of thermal expansion than the coefficient of thermal expansion of the disk. In another embodiment, the bottom surface of the root extends laterally in the slot and is spaced laterally from the first sidewall of the disk by a gap L and from the second sidewall by a gap L'. The seal means, including the first element and the baffles, is coated with a shearable coating. The first element extends between the root of the blade and the first and second sidewalls of the slot to block leakage of cooling air from the cavity through the lateral gaps L and L'.

A primary advantage of the present invention is the efficiency of a gas turbine engine which results from blocking the leakage of cooling air from a rotor disk-blade assembly by use of a seal means disposed in the blade attachment slot. In one embodiment, an advantage is the slidable engagement between the seal means and the rotor blade which damps vibrations in the rotor blade during operation of the engine. Another advantage is the cost of fabrication which results from utilizing a casting which is relatively inexpensive to make and using a shearable coating applied to the casting to provide a good fit between the seal means and the disk blade assembly.

The foregoing features and advantages of the present invention will become more apparent in the light of the following detailed description of the best mode for carrying out the invention and in the accompanying drawings.

BEST MODE FOR CARRYING OUT INVENTION

Figure 1:
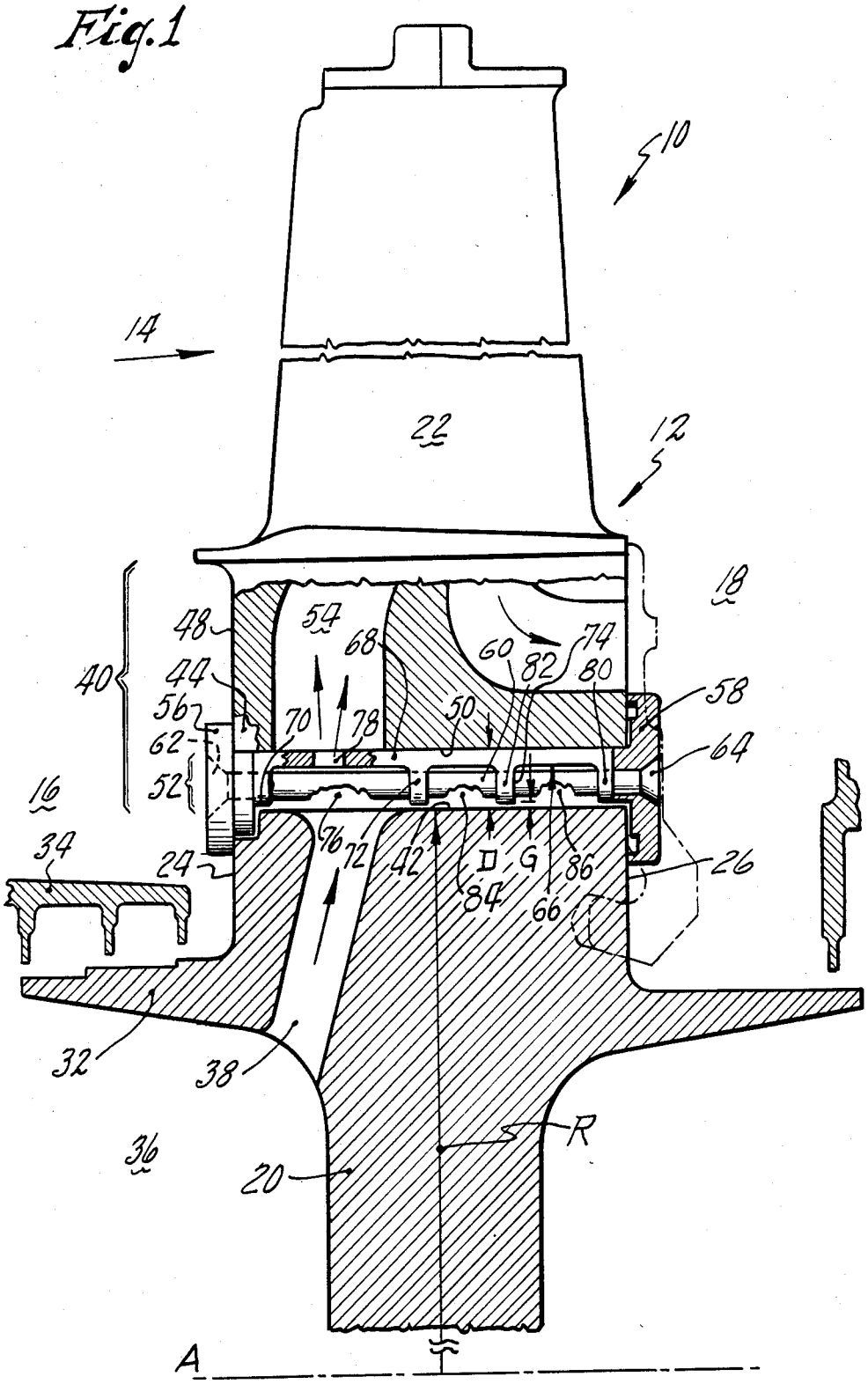
FIG. 1 is a side elevation view of a rotor assembly for an axial flow gas turbine engine with a portion of the disk broken away to show a rotor blade and a seal means and with a portion of a rivet broken away to show a sidewall of the disk.

FIG. 1 is an axial flow gas turbine engine embodiment of the present invention and shows a sectional view of a portion of the turbine section 10 of such an engine. The turbine section includes a rotor assembly 12 having an axis of rotation A. An annular flow path 14 for hot working medium gases at elevated pressures extends axially through the rotor assembly. The flow path is adjacent a first region 16 and a second region 18. The first region is at a pressure different than the second region. In the embodiment shown, the first region is at a higher pressure than the second region.

The rotor assembly 12 includes a rotor disk 10 and a plurality of rotor blades extending outwardly from the disk into the working medium flow path as represented by the single rotor blade 22. The rotor disk extends circumferentially about the axis A. The rotor disk has a first face 24 adjacent the first region and a second face 26 adjacent the second region. A seal land 32 extends circumferentially about the disk. A stator structure 34 extends circumferentially about the seal land 32 to form a source of cooling air such as chamber 36. The chamber is in flow communication with a portion of the engine that compresses air to a suitable pressure and temperature such as the high pressure compressor of the engine (not shown). A plurality of passages for cooling air, as represented by the single passage for cooling air 38, are in flow communication with the chamber for cooling air.

The rotor disk 20 has a plurality of blade attachment slots, as represented by the single blade attachment slot 40, which are circumferentially spaced one from the other about the periphery of the disk. Each slot is in flow communication with a passage 38 for cooling air and, through the passage, with the chamber 36 for cooling air. The disk at each slot has a bottom wall 42 and two sidewalls. The rotor blade is broken away to show one of the sidewalls, first sidewall 44. A second sidewall 46 (not shown) faces the first sidewall and is broken away to show the blade and slot. The sidewalls diverge in the radial direction R to form a fir-tree shape which adapts the disk to receive an associated rotor blade at the slot.

The blade 22 has a root 48 having a shape corresponding to the fir tree slot which adapts the blade to engage the disk. The root has a bottom surface 50. The bottom surface is spaced radially from the bottom wall by a distance D leaving a cavity 52 therebetween. A passage 54 for cooling air extends through the coolable rotor blade to the blade attachment slot and is in flow communication with the cavity in the slot.

The rotor assembly 12 has a first end piece 56 which overlaps the root 48 and the first face 24 of the disk and extends between the root, the bottom wall 42 and the sidewalls 44,46 of the disk to block leakage of the cooling air from the cavity 52 toward the first region 16. A second end piece 58 overlaps the root and the second face 26 of the disk and extends between the root, the bottom wall and the sidewalls to block the leakage of cooling air from the cavity toward the second region 18. The second end piece may be of the design shown or a more conventional sideplate as shown by the broken lines. An axially extending member, such as rivet 60, is disposed in the cavity. The rivet extends from the first piece to the second piece. The rivet has a first head 62 which exerts a force on the first piece and a second head 64 which exerts a force on the second piece to urge the first and second end pieces against the faces of the disk.

A seal means 66 for the blade attachment slot 40 is disposed in the cavity 52. The seal means has a first element, such as seal plate 68, which is disposed between the rivet 60 and the bottom surface 50 of the root to block the leakage of cooling air from the cavity in the radial direction. At least two baffles integral with the seal plate, such as the first baffle 70 and the second baffle 72, are spaced axially one from the other. The baffles extend radially and laterally across the cavity. The baffles are each adapted by a hole 74 to accommodate the rivet 60 which extends through the cavity.

The baffles 70, 72 extend radially past the rivet into close proximity with the bottom wall 42 of the disk to define a first chamber 76 for cooling air. The term "close proximity" means that the seal means extends at least 90% of the radial distance D between the bottom surface 50 of the rotor blade and the bottom wall of the disk leaving a gap G between the seal means and the bottom wall and sidewalls of the disk which is equal to or less than ten percent of the radial height D ($G \leqq 0.10D$). The first chamber is in flow communication with the passage 38 for cooling air in the disk. An orifice 78 for cooling air in the seal plate extends between the baffles to place the chamber in flow communication with the passage for cooling air in the blade. A third baffle 80 and a fourth baffle 82 define a second cooling air chamber 84 and a third cooling air chamber 86.

Figure 2:
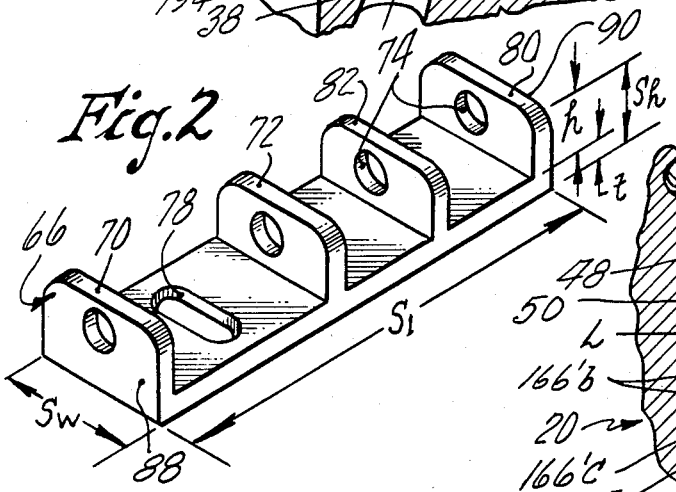
FIG. 2 is a perspective view of the seal means shown in FIG. 1.

FIG. 2 is a perspective view of the seal means 66 shown in FIG. 1 as viewed from below to show the baffles 70,72, 80 and 82. The seal means has a rectangular shape having an axial length $S_l$, an axial width $S_w$, and an overall radial height $S_h$. The seal plate 68 has a tickness t. The baffles extend from the seal plate a distance h, the distance h being measured perpendicular to the seal plate and being at least twice the cross-sectional thickness t ($h \geqq 2t$). The seal plate has a first end 88 and a second end 90. At least one baffle, such as the first baffle 70, extends from the seal plate between the first end and the orifice 78. At least one baffle, such as the second baffle 72, extends from the seal plate between the second end and the orifice.

The seal means may be formed of any suitable material. One suitable material is a high temperature nickel base alloy, such as a cast, precipitation hardenable alloy known as Inconel 718 (by weight percent, 19 Cr, 0.9 Ti, 0.6 Al, 3 Mo, 18 Fe, 5 (Cb+Ta), balance nickel).

Figure 3:
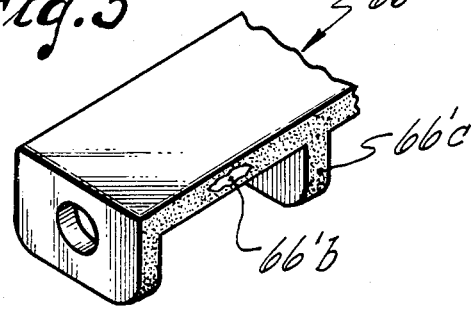
FIG. 3 is a partial perspective view of an alternate embodiment of the seal means shown in FIG. 2 showing a seal means which has a shearable coating.

FIG. 3 is an alternate embodiment 66' of the seal means 66 shown in FIG. 2 which is formed of a first material, such as a base material **66'*b*, and a second material 66'*c*** applied as a coating to the base material. The base material has a first strength in shear. The coating material has a second strength in shear which is less than the first strength in shear to form a shearable coating on the seal means. Examples of such coatings and methods for applying the coating are discussed in U.S. Pat. No. 3,879,831 issued to Rigney et al. entitled "Nickel Base High Temperature Abradable Material" and U.S. Pat. No. 3,147,087 issued to Eisenlohr entitled "Controlled Density Hetrogeneous Material and Article". One satisfactory material for the coating is a nickel graphite composite of the type used in rubstrip applications for air sealing rings in a turbine of a gas turbine engine. The nickel graphite coating is applied by a suitable method, such as flame spraying a nickel-coated graphite powder, on the surface of the base material. A satisfactory nickel-coated graphite powder is available from METCO, Inc., Westbury, N.Y. (by weight percent, 74–76 Ni, 0.8 maximum impurities, remainder C).

Figure 4:
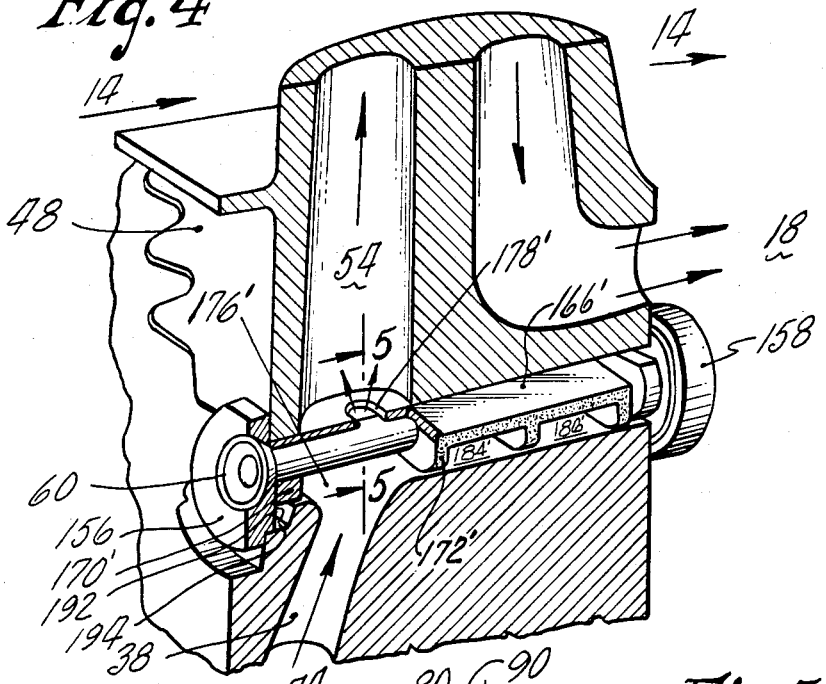
FIG. 4 is a partial perspective view of an alternate embodiment of the rotor assembly shown in FIG. 1 with portions of the rotor blade and the rotor disk broken away for clarity.

FIG. 4 is a partial perspective view of an alternate embodiment of the seal means 66' showing a coated seal means 166' having a seal means integral with one of the end pieces, such as the first end piece 156. The first end piece has a shoulder 192. A groove 194 in the disk at the slot adapts the disk to receive the end piece at the first face of the disk. Because the second face does not have a disk groove, reverse installation of the integral seal means 166' increases the distance between end pieces and prevents the rivet 60, which has a preselected length, from engaging both end pieces. In a like manner, the shoulder prevents an upside down installation of the seal means. As a result, the integral seal means-end piece construction insures the first baffle 170 and the second baffle 172 engage the disk on either side of the cooling air passage 38 in the disk to form the first chamber 176' for cooling air. The orifice 178' is located correctly and places the first chamber in flow communication with the cooling air passage 54 in the rotor blade. The cooling air passage in the blade is in flow communication with the second region 18 of the working medium flow path 14.

Figure 5:
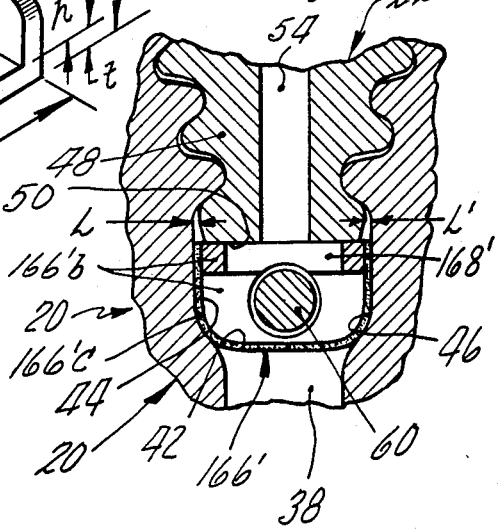
FIG. 5 is a view taken along the lines 5—5 of FIG. 4.

FIG. 5 is a view taken along the lines 5—5 of FIG. 4 showing in greater detail the base material **166'*b*, the coating material 166'*c* of the seal means 166' and the relationship of the seal means to the disk 20 and the rotor blade 22. The bottom surface 50 of the root 48 extends laterally in the slot, that is, in a direction perpendicular to both the axial and radial directions. The bottom surface is spaced laterally from the first sidewall 44 of the disk by a gap L and from the second sidewall 46** by a gap L'.

The seal plate 168' extends laterally beyond the bottom surface of the blade toward the first sidewall and the second sidewall to slidably engage the sidewalls of the disk and the bottom surface of the rotor blade. In embodiments not having a coating, tolerance requirements may cause the seal plate to be spaced a small distance from the sidewalls of the disk. Although the seal plate extends laterally beyond the bottom surface of the blade and into close proximity with the sidewalls, a gap remains that permits a greater amount of leakage into the lateral gap L and L' than does the seal plate 168'. The gaps L and L' extend in a generally axial direction between the blade and the disk to the first face 24 and the second face 26 of the disk.

Figure 6:
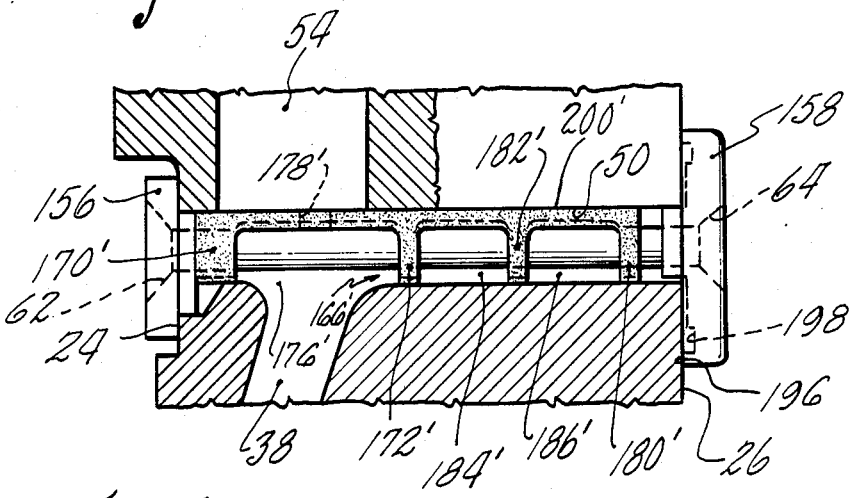
FIG. 6 is a side elevation cross-sectional view of a portion of the rotor assembly shown in FIG. 4 taken along a plane which passes through the axis A.

FIG. 6 is a side view of the seal means 166' shown in FIG. 4 under operative conditions. As shown in FIG. 4 and FIG. 6, the first end piece 156 and the second end piece 158 extend over the root and faces of the disk to block the leakage of cooling air from the gaps L and L'. The second end piece 158 has a rim 196 extending circumferentially about the perimeter of the end piece. An undercut portion 198 spaces the interior portion of the end piece away from the disk to decrease the surface area of the end piece bearing on the disk and on the rotor blade.

As shown in FIG. 6, the seal means 166' is urged outwardly against the rotor blade. The seal means has an uncoated surface 200'. The uncoated surface slidably engages the bottom surface 50 of the blade. The first baffle 170' engages the rotor disk at a location between the passage for cooling air 38 in the disk and the first face of the disk 24. The second baffle, 172' spaced axially from the first baffle, engages the rotor disk at a location between the passage for cooling air in the disk and the second face of the disk 26. A third baffle 180' spaced axially from the second baffle engages the rotor disk at a location between the second baffle and the second face of the disk. A fourth baffle 182' disposed between the second and third baffles engages the rotor disk at a location between the second and third baffles. The second and fourth baffles define a second cooling air chamber 184'. The third and fourth baffles define a third cooling air chamber 186'.

Figure 7:
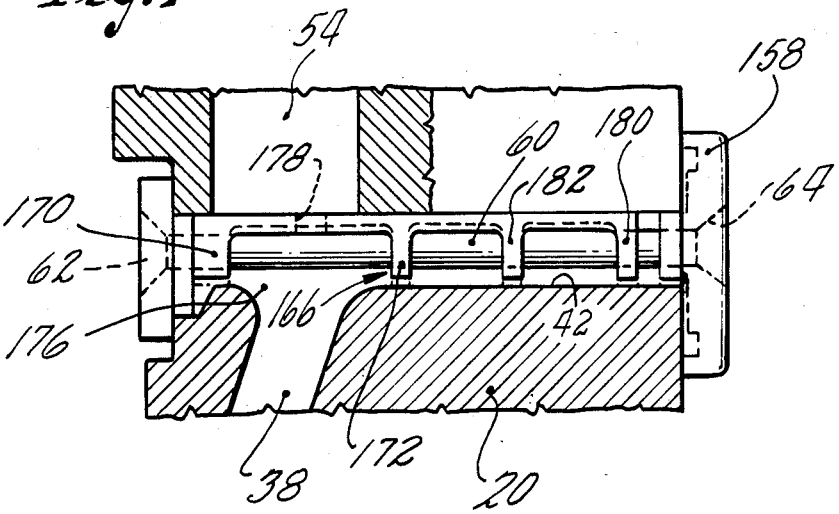
FIG. 7 is a view corresponding to the view taken in FIG. 6 showing an alternate embodiment of the seal means wherein the moved position of the seal means with respect to the disk under operative conditions is shown by the broken lines.

FIG. 7 shows an alternate embodiment 166 of the seal means 166' shown in FIG. 6 which does not have a coating of a shearable material. The seal means 166 is formed of a material having a coefficient of expansion greater than the coefficient of expansion of the rotor disk 20. The position of the seal means at rest before operation is shown by the solid lines. The broken lines show the moved position (exaggerated for clarity) of the seal means with respect to the bottom wall 42 of the rotor disk 20 as the seal means grows radially inwardly in response to an increase in temperature. As shown, the operating temperatures and coefficient of thermal expansion selected for the seal means and the coefficient of thermal expansion of the disk cause the baffles to grow toward the disk and to engage the disk under operative conditions. A smaller growth will result in a small clearance between the baffle and the disk.

During fabrication of the seal means shown in FIG. 4 and FIG. 6, the coating applied to the seal means causes the seal means to be oversided in comparison with an uncoated seal means that would easily slide into the slot, such as the seal means shown in FIG. 7. The increased size of the coated seal means causes an interference fit between the seal means and the adjacent surfaces on the blade and the disk. Most seal means will employ a coating that is greater than five percent of the vertical height $S_h$ although some benefit is provided by thinner coatings. In one embodiment, a seal means employs a base material having an overall vertical dimension $S_h$ which is equal to two hundred and thirty thousandths of an inch ($S_h$=0.230 inches) with a coating having a thickness of fifteen to twenty thousandths of inch thick.

During installation, the seal means is tapped with a plastic hammer and driven home as a nail is driven into a piece of wood. The shearable coating shears to provide a tight fit between the seal means and the rotor blade and the seal means and the rotor disk.

A particular advantage of the coated design is the cost of fabrication which results from using a relatively inexpensive casting for the base material followed by a coating with a shearable material. Seal means, such as the seal means 66 and 166, require expensive machining operations to fabricate the seal means to close tolerances.

During operation of the gas turbine engine, hot working medium gases at elevated pressures are flowed along the annular flow path 14 which extends through the turbine section 10 of the engine. Components of the rotor assembly 12, such as the rotor blades 22 which are bathed in the hot gases, receive heat from the gases and are cooled by cooling air which is flowed to the rotor assembly.

In the embodiment shown in FIG. 4, the cooling air is supplied at a pressure which is slightly higher than the pressure in the first region and much higher than the pressure on the second region. The cooling air is flowed from chamber 36, through a passage for cooling air 38 in the disk to the first chamber 176 in the blade attachment slot. The air is metered through the orifice 178' in the seal plate 168 to the cooling passage 54 in the blade. The cooling air is passed through the blade to remove heat from the blade before being discharged into the working medium flow path.

Because the cooling air is pressurized by the compressor, a loss of the cooling air without performing the cooling function requires the diversion of more cooling air from the compressor, decreasing the efficiency of the gas turbine engine. Additional losses not replaced by additional cooling air from the compressor will result in decreased cooling, an increase in temperature of the insufficiently cooled components, followed by an earlier than normal failure of the components. The first cooling air chamber 176' blocks the radial leakage of cooling air into the lateral gaps L and L' between the rotor blade 22 and the disk 20 with the seal plate 68 and blocks the axial leakage toward the lower pressure second region and toward the higher pressure first region with baffles 170' and 172'.

The difference in pressure between the first cooling air chamber 176' and the second region 18 is greater than the difference in pressure between the first cooling air chamber 176' and the first region 16. Because the leakage of cooling air is directly proportional to the difference in pressure between the two regions and inversely proportional to flow resistance between the two regions, intermediate cooling chambers are provided to increase the flow resistance, such as the second cooling air chamber 184' and the third cooling air chamber 186'. These chambers are operated at pressure intermediate to the pressures in chamber 176' and region 18. If cooling air leaks into these chambers, the resistance to leakage is increased by the sudden contraction and the sudden expansion the leakage flow experiences at the engagement between each baffle and the disk as the flow leaves one chamber and enters the next. The combination of tight sealing with sudden expansions and contractions has reduced leakage markedly as compared with constructions which do not employ such a seal means. Other embodiments shown in FIG. 1 and FIG. 7 operate in a like manner.

As the hot working medium gases pass along the flow path 14 through the array of rotor blades 22, energy is imparted to the rotor assembly causing the assembly to rotate at speeds of many thousands of revolutions per minute. Rotational forces acting on the seal means 166' urge the seal means radially outwardly against the bottom surface 50 of the rotor blade causing the seal means to press tightly against the rotor blades. In embodiments where thermal expansion causes the baffles to press tightly against the rotor disk, an equal and opposite force causes the seal plate to press against the underside of the rotor blade further increasing the rotational sealing force.

Variations in flow of the working medium gases, vibrations in the engine and the inherent vibrational characteristics of the rotor blade induce vibrations in the rotor blades. The vibrations in the rotor blades cause microscopic movement between the rotor blade and the seal means which dissipates vibrational energy as heat through friction. This energy is dissipated both as rubbing contact between the rotor blade and the seal means and as rubbing contact between the seal means and the disk. As will be appreciated, in those constructions in which the seal means is integral with the rotor blade, this microscopic movement will only take place between the disk and the seal means.

Although the invention has been shown and described with respect to detailed embodiments thereof, it should be understood by those skilled in the art that various changes in form and detail thereof may be made without departing from the spirit and the scope of the claimed invention.

What is claimed is:

1. A seal means adapted for use in a blade attachment slot of a gas turbine engine which comprises:

a seal plate having rectangular shape, a width Sw, a first end, a second end, an axial length $S_l$ between the ends, a cross-sectional thickness t and an orifice extending therethrough;

a plurality of baffles integral with the seal plate which extend across the width Sw of the plate a distance equal to the width of the seal plate and from the seal plate a distance h, the distance h being measured perpendicular to the seal plate and being at least twice the cross-sectional thickness t ($h \leqq 2t$), wherein at least one baffle extends from the seal plate between the first end and the orifice, wherein at least one baffle extends from the seal plate between the second end and the orifice and wherein at least one additional baffle extends from the seal plate between said baffles and said orifice.

2. The seal means as claimed in claim 1 wherein the seal means further is formed of a first material having a first strength in shear and a second material which is coated on the first material, the second material having a second strength in shear which is less than the first strength in shear.

3. The seal means as claimed in claim 2 wherein the first material is a nickel alloy casting and wherein the second material is a sprayed nickel graphite composite.

* * * * *